United States Patent [19]

Rossini

[11] 4,078,512

[45] Mar. 14, 1978

[54] LIGHTWEIGHT ANCHOR CHOCK ASSEMBLY

[76] Inventor: Alfred P. Rossini, 6 Belmore Rd., Framingham, Mass. 01701

[21] Appl. No.: 746,099

[22] Filed: Dec. 1, 1976

[51] Int. Cl.[2] ..... B63B 21/22

[52] U.S. Cl. ..... 114/210; 114/310; 114/221 R

[58] Field of Search ..... 114/210, 310; 24/255, 24/261 A

[56] References Cited

U.S. PATENT DOCUMENTS

| | | | |
|---|---|---|---|
| 1,162,891 | 12/1915 | Tiffany | 24/261 |
| 2,705,467 | 4/1955 | Ogg et al. | 114/210 |
| 3,785,323 | 1/1974 | Lantz | 114/210 |
| 3,991,699 | 11/1976 | Bass | 114/210 |

*Primary Examiner*—Trygve M. Blix
*Assistant Examiner*—Edward M. Wacyra
*Attorney, Agent, or Firm*—Irving M. Kriegsman

[57] ABSTRACT

A chock assembly for a lightweight anchor. The assembly is made up of two parts, a hollow heel shaped unit for holding the crown of the anchor and a unit having an oval ring shaped structure for holding the fluke tips and shank of the anchor.

8 Claims, 1 Drawing Figure

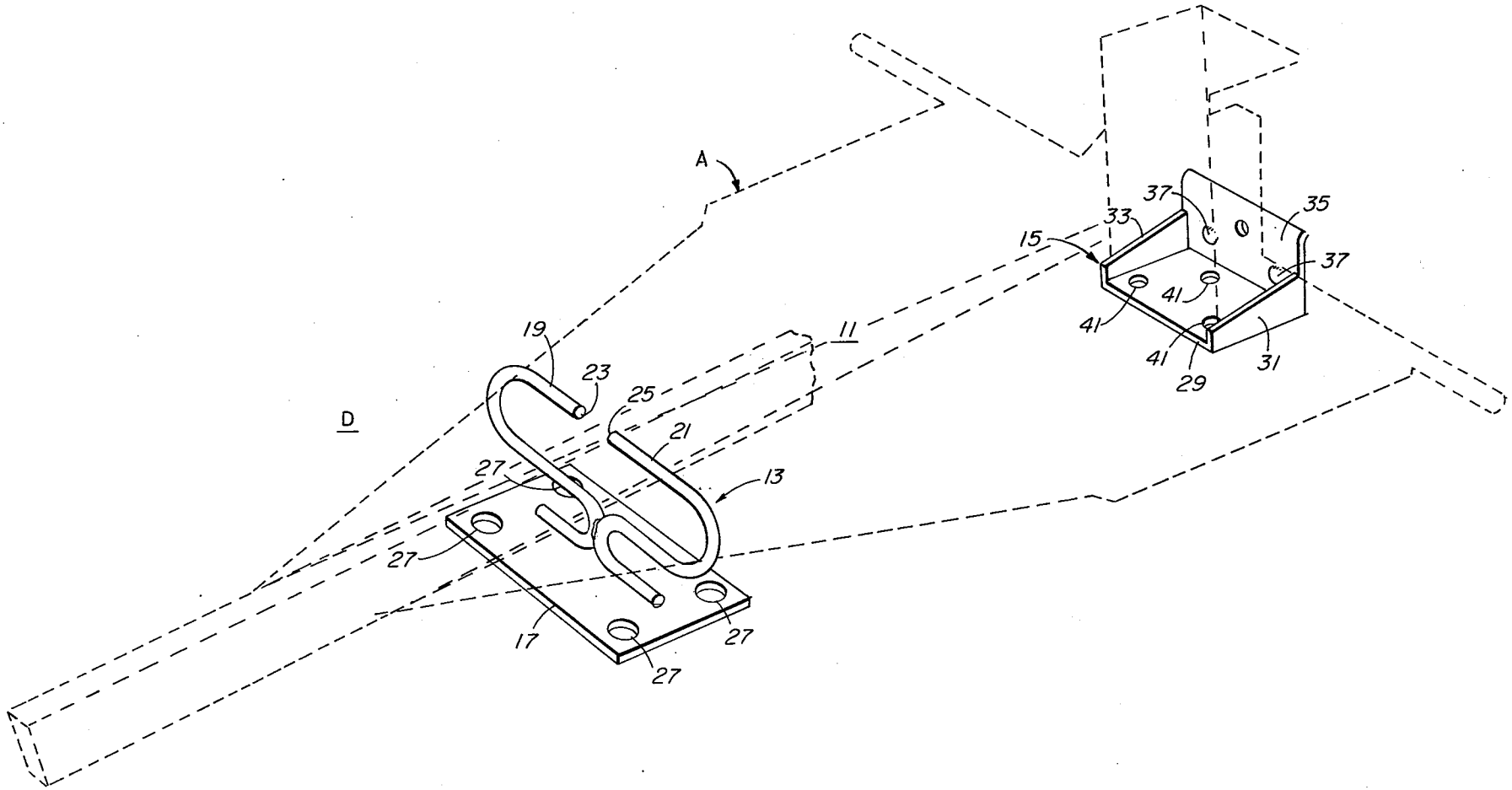
35
37
31
29
41
41
41
37
33
15
11
13
27
27
21
25
23
19
17
27
27
A
D

LIGHTWEIGHT ANCHOR CHOCK ASSEMBLY

BACKGROUND OF THE INVENTION

This invention relates to lightweight anchors. More particularly this invention relates to a chock assembly for use in holding down a lightweight anchor on the deck or other surface of a boat.

A lightweight anchor is a type of marine anchor that is well known in the art and widely used with boats of all sizes. The main parts of a lightweight anchor are the stock, the crown, the shank and the flukes. The parts are assembled such that the flukes are fixed relative to the crown and pivotally movable within certain angular limits relative to the shank. In my copending patent application Ser. No. 746,100 filed concurrently with this patent application, the subject matter of which patent application is incorporated herein by reference, there is described a lightweight anchor in which the flukes are made of two sheets of plate stock material, stacked one on top of the other and laminated together. Other examples of lightweight anchors can be found in U.S. Pat. No. 3,780, 688 and U.S. Pat. No. 3,782,318.

When not being used to hold a boat in place in water, lightweight anchors are usually either stowed away underneath the deck, attached to one of the rails or one of the stanchions on the boat or secured to the top of the deck or some other flat surface on the boat. Devices for securing the anchors to the deck or other similar surface are generally referred to as chocks or chock assemblies. One known type of chock assembly for lightweight anchors is made up of a crown holding unit, a pair of channel shaped fluke tip support units and a shank tip support unit. The assembly is used by sliding the crown of the anchor into the crown holding unit and then allowing the two fluke tips and shank to drop down into their respective units. Another example of a chock assembly designed for use with lightweight anchors can be found in U.S. Pat. No. 3,785,323.

SUMMARY OF THE INVENTION

It is an object of this invention to provide a new and improved chock assembly for a lightweight anchor.

It is another object of this invention to provide a chock assembly that is particularly suited for use with the lightweight anchor described in my aforementioned copending patent application Ser. No. 746,100.

It is another object of this invention to provide a chock assembly for a lightweight anchor that is made up of only two units, is easy to fabricate, easy to install, and easy to use.

It is yet still another object of this invention to provide a chock assembly in which at least one of the units can be used for purposes other than holding down an anchor.

It is another object of this invention to provide a chock assembly which secures the anchor being held down from theft.

A chock assembly constructed according to this invention is made up of two parts, a crown holding unit and a combination fluke tip and shank holding unit. The crown holding unit is a hollow heel shaped member which supports the crown and holds the crown against vertical and horizontal movement. The unit is designed so that the crown will snap-lock into place and includes means for securing the anchor against theft. The combination fluke tip and shank holding unit includes a member that is shaped so that one portion serves as a holder for the two fluke tips and a seat for the shank and another portion serves as a cleat. In addition, the portion serving as the holder for the two fluke tips and the shank can function as a fairlead. The anchor is mounted in the chock assembly by first inserting the fluke tips into the proper portion of the fluke tips and shank holding unit and then dropping the shank into the fluke tip and shank holding unit and pushing the crown down into the crown holding unit. Both units are made of stainless steel.

The foregoing and other objects and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWING

In order that the invention may be more fully understood, it will now be described, by way of example, with reference to the accompanying drawing in which like reference numerals or characters represent like parts and wherein:

The sole FIGURE is a perspective view of a chock assembly constructed according to this invention, attached to the deck of a boat and holding a lightweight anchor.

DESCRIPTION OF PREFERRED EMBODIMENT

Referring now to the drawing, there is shown a chock assembly for use with a lightweight anchor constructed according to this invention and identified generally by reference numeral 11. Chock assembly 11 is shown mounted on the deck D of a boat and holding down a lightweight anchor identified by reference character A.

Chock assembly 11 is made up of two units, a combination fluke tips and shank holding unit 13 and a crown holding unit 15.

Combination fluke tips and shank holding unit 13 includes a flat rectangular base 17 of stainless steel. Welded to base 17 are a pair of upwardly extending S-shaped stainless steel rods 19 and 21. Rods 19 and 21 are positioned facing each other, in contact at the curved portions of their bottom loops and welded together at their areas of contact. The top loops of rods 17, 18 are flattened out, so as to define between them a generally flat oval ring-shaped area. The length of the oval is greater than the distance between the tips of the flukes of anchor A but less than the distance between the outer edges of the flukes. The upper ends 23 and 25 of rods 19 and 21 respectively are spaced apart a distance slightly greater than the thickness of the shank of anchor A so that the shank can be lowered into and raised out of the oval area. Base 17 is provided with a plurality of suitably placed holes 27 so that it can be mounted on the deck D by screws or other suitable means (not shown).

Crown holding unit 15 is a hollow heel-shaped member having a flat rectangular base 29, a pair of sidewalls 31 and 33 and a backwall 35 that is vertically extending from the base 29 but bent back slightly near the top and formed on its inner surface near the bottom but spaced upward therefrom with a pair of integral projections or bumps 37. Backwall 35 also includes a hole 39 located on the vertical portion above the bumps 37 but below the bent back portion.

Base 29 is provided with a plurality of suitably spaced holes 41 so that it can be mounted on the deck D by screws or other suitable means (not shown). The cavity of crown holding unit 15 defined by the base, sidewalls and backwall is sized and shaped to conform to the crown of the anchor A and to provide a snug fit for the crown, when it is seated in the cavity. Crown holder 15 is made of stainless steel plate stock.

Chock assembly 11 is used by first inserting the fluke tips into the flat oval portion of th fluke tips and shank holding unit 13 and pushing the tips forward through the oval portion as far as they will go and then pushing the crown of the anchor A down into crown holding unit 15 and allowing the shank to drop into the fluke tips and shank holding unit 13. Because of bumps 35 in backwall 35, the crown of anchor A will snap-fit into crown holder 15 and be snugly secured in place. The shank of the anchor will seat on the small V-shaped groove formed above where the two S-shaped rods 19 and 21 are joined together. The anchor A is secured against theft by placing a padlock (not shown) through hole 39 in crown holding unit 15. The U-portion of the padlock will constitute an obstruction which prevents the crown of the anchor A from being lifted out.

The bottom portion of S-shaped rods 19 and 21 which form a pair of flattened out C's facing away from each other can be used as a cleat. The flat oval upper portion of two rods 19 and 21 can be used as a fairlead when its is not supporting the anchor A.

Instead of being of bar stock and plate material holding unit 13 or any parts thereof can, if desired, be made of a casting or forged or extruded. Holding unit 15 can also, if desired, be cast, forged or extruded.

The embodiment of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A chock assembly for a lightweight anchor having a crown, a shank, a stock and a pair of tipped flukes, said chock assembly comprising: a unit for holding the shank and fluke tips and a unit for holding the crown, the unit for holding the shank and fluke tips including an upwardly extending structure having a vertically disposed, oval shaped, ring defining area in which the fluke tips can be slidably inserted therein from a horizontal direction and once inserted be secured against vertical dislodgement and the unit for holding the crown is a hollow, heel-shaped member having upwardly extending generally straight, inner side walls in which said crown is inserted therein by being pushed downward therein in generally vertical direction.

2. A chock assembly for a lightweight anchor, said lightweight anchor having a crown, a shank, a stock and a pair of tipped flukes, said chock assembly comprising: a unit for holding the shank and fluke tips and a unit for holding the shank and fluke tips and a unit for holding the crown, the unit for holding the shank and fluke tips including an upwardly extending structure having a vertically disposed, oval shaped, ring defining area in which the fluke tips and shank are inserted and held and the unit for holding the crown being a hollow heelshaped member, said upwardly extending structure including two generally S-shaped members facing each other and joined together at their bottom loop portions, the upper loop portions of the two S-shaped members defining the oval shaped area.

3. The chock assembly of claim 2 and wherein the oval shaped area is flattened and slotted at the top.

4. The chock assembly of claim 3 and wherein the unit for holding the shank and fluke tips includes a base and wherein the upwardly extending structure is rigidly secured to the base.

5. The chock assembly of claim 4 and wherein the hollow heel shaped member has a base, a back wall and is open at the top and at the front.

6. The chock assembly of claim 5 and wherein the side walls extend upward vertically.

7. A chock assembly for a lightweight anchor, said lightweight anchor having a crown, a shank, a stock and a pair of tipped flukes, said chock assembly comprising: a unit for holding the shank and fluke tips and a unit for holding the crown, the unit for holding the shank and fluke tips including a base and an upwardly extending structure rigidly secured to the base and having a vertically disposed oval shaped ring defining area in which the fluke tips and shank are inserted and held, the upwardly extending structure including two generally S-shaped members facing each other and joined together at their lower portions, the upper looped portions of the two S-shaped members defining the oval-shaped area, the oval shaped area being flattened and slotted at the top, the unit for holding the crown being a heel-shaped member having a base, a pair of side walls, a back wall and being open at the top and at the front, the inner surface of the back wall including a pair of outwardly extending projections for producing a snap-on type action when the crown is inserted therein.

8. The chock assembly of claim 7 and wherein the backwall is further provided with an aperture through which can be inserted a padlock for preventing the crown from being removed after it is inserted in place therein.

* * * * *